US011248410B2

(12) United States Patent
Dreyer et al.

(10) Patent No.: US 11,248,410 B2
(45) Date of Patent: Feb. 15, 2022

(54) CONFIGURATION OF ENTRANCE SYSTEMS HAVING ONE OR MORE MOVABLE DOOR MEMBERS

(71) Applicant: ASSA ABLOY ENTRANCE SYSTEMS AB, Landskrona (SE)

(72) Inventors: Roger Dreyer, Bjarred (SE); Sven-Gunnar Soderqvist, Vallakra (SE); Philipp Triet, Bad Ragaz (CH)

(73) Assignee: Assa Abloy Entrance Systems AB, Landskrona (SE)

( * ) Notice: Subject to any disclaimer, the term of this patent is extended or adjusted under 35 U.S.C. 154(b) by 36 days.

(21) Appl. No.: 16/641,598

(22) PCT Filed: Aug. 30, 2018

(86) PCT No.: PCT/EP2018/073297
§ 371 (c)(1),
(2) Date: Feb. 24, 2020

(87) PCT Pub. No.: WO2019/043084
PCT Pub. Date: Mar. 7, 2019

(65) Prior Publication Data

US 2020/0224484 A1 Jul. 16, 2020

(30) Foreign Application Priority Data

Sep. 1, 2017 (SE) ..... 1730233-2

(51) Int. Cl.
*E05F 15/00* (2015.01)
*E05F 15/73* (2015.01)
(Continued)

(52) U.S. Cl.
CPC ..... *E05F 15/73* (2015.01); *E05F 15/603* (2015.01); *E05F 15/77* (2015.01);
(Continued)

(58) Field of Classification Search
CPC ..... E05F 15/611; E05F 15/00; E05F 15/603; E05F 15/70; E05F 15/77; E05F 15/76;
(Continued)

(56) References Cited

U.S. PATENT DOCUMENTS 4,851,746 A * 7/1989 Milke ..... G01S 17/04 318/467
6,392,532 B2 * 5/2002 Minata ..... H04M 1/575 340/7.48
(Continued)

FOREIGN PATENT DOCUMENTS

| | | |
|---|---|---|
| DE | 102010014806 | 8/2011 |
| EP | 1633950 | 3/2006 |
| EP | 2592830 | 5/2013 |

OTHER PUBLICATIONS

LIFT-Report Jan. 2018; [retrieved on Mar. 13, 2018] Retrieved from the Internet <URL: aufzugtueren.de/fileadmin/media/aufzugtueren/common/documents/Fachartikel/FA_1801_LR_en.pdf>; whole document.
SE Search Report mailed in SE 1730233-2 dated Mar. 27, 2018.
International Search Report mailed in PCT/EP2018/073297 dated Dec. 11, 2018.

*Primary Examiner* — Chi Q Nguyen
(74) *Attorney, Agent, or Firm* — Wissing Miller LLP

(57) ABSTRACT

A control arrangement for an entrance system, having one or more movable door members and an automatic door operator for causing movements of the one or more movable door members between closed and open positions, includes a controller and one or more sensor units. Each sensor unit is connected to the controller and arranged to monitor a respective zone at the entrance system for presence or activity of a person or object. At least one sensor is an image-based sensor unit having an image sensor arranged for capturing an image of an external object, a memory arranged for storing a plurality of settings for the image-based sensor unit, and a processing device. The processing
(Continued)

device is arranged for processing the image captured by the image sensor to identify a machine-readable optical code therein, deriving a configuration instruction encoded by the optical code, and executing the configuration instruction.

20 Claims, 9 Drawing Sheets

(51) Int. Cl.
*E05F 15/603* (2015.01)
*E05F 15/77* (2015.01)

(52) U.S. Cl.
CPC ..... *E05F 2015/767* (2015.01); *E05Y 2400/44* (2013.01); *E05Y 2400/852* (2013.01); *E05Y 2800/00* (2013.01); *E05Y 2900/132* (2013.01)

(58) Field of Classification Search
CPC ..... E05F 15/73; E05F 2015/767; E05F 2015/765; E05Y 2400/80; E05Y 2400/852; E05Y 2400/00; E05Y 2900/132; E05Y 2400/30; E05Y 2400/456; E05Y 2800/00; E05Y 2400/44
USPC ..... 49/31, 13, 506; 340/5.7, 5.71
See application file for complete search history.

(56) References Cited

U.S. PATENT DOCUMENTS

2006/0097844 A1* 5/2006 Nakashima ..... G07C 9/00309 340/5.52
2006/0244403 A1 11/2006 Christensson
2008/0022596 A1* 1/2008 Boerger ..... G08B 5/36 49/31
2008/0236048 A1* 10/2008 Kowalczyk ..... E05F 3/224 49/280
2009/0093913 A1* 4/2009 Copeland, II ..... E05F 1/002 700/282
2009/0139142 A1* 6/2009 Li ..... E05F 15/73 49/26
2012/0068818 A1 3/2012 Mizon
2013/0009785 A1* 1/2013 Finn ..... G08B 7/06 340/870.01
2013/0127590 A1 5/2013 Braverman
2013/0186001 A1* 7/2013 Cui ..... E06B 9/68 49/31
2014/0022077 A1* 1/2014 Zenisek ..... E05F 17/004 340/545.1
2015/0355828 A1* 12/2015 Kiyomasa ..... G06F 3/04817 715/771
2017/0124011 A1* 5/2017 Verdino ..... G06F 13/385
2017/0275938 A1* 9/2017 Langenberg ..... E05F 15/70

* cited by examiner

A configuration method for an entrance system

CONFIGURATION OF ENTRANCE SYSTEMS HAVING ONE OR MORE MOVABLE DOOR MEMBERS

This application is a 371 of PCT/EP2018/073297 filed on Aug. 30, 2018, published on Mar. 7, 2019 under publication number WO 2019/043084, which claims priority benefits from Swedish Patent Application No. 1730233-2 filed on Sep. 1, 2017, the disclosure of which is incorporated herein by reference.

TECHNICAL FIELD

The present invention generally relates to configuration of entrance systems having one or more movable door members and an automatic door operator for causing movements of the one or more movable door members between closed and open positions. More specifically, the present invention relates to a control arrangement for such entrance systems, wherein the control arrangement has one or more sensor units, each sensor unit being arranged to monitor a respective zone at the entrance system for presence or activity of a person or object. The present invention also relates to an entrance system comprising such a control arrangement, to a computerized system and to an associated configuration method for an entrance system.

BACKGROUND

Entrance systems having automatic door operators are frequently used for providing automatic opening and closing of one or more movable door members in order to facilitate entrance and exit to buildings, rooms and other areas. The door members may for instance be swing doors, sliding door or revolving doors.

Since entrance systems having automatic door operators are typically used in public areas, user convenience is of course important. The entrance systems need to remain long-term operational without malfunctions even during periods of heavy traffic by persons or objects passing through the entrance systems. At the same time, safety is crucial in order to avoid hazardous situations where a present, approaching or departing person or object (including but not limited to animals or articles brought by the person) may be hit or jammed by any of the movable door members.

Entrance systems are therefore typically equipped with a control arrangement including a controller and one or more sensor units, where each sensor unit is connected to the controller and is arranged to monitor a respective zone at the entrance system for presence or activity of a person or object. In order to provide user convenience and long-term operational stability and at the same time prevent injuries or damages to present, approaching or departing persons or objects, it is of paramount importance that the sensor units provide accurate output signals to the controller. The controller, which may be part of the automatic door operator or a separate device, controls the operation of the automatic door operator—and therefore the automatic opening and closing of the movable door members—based on the output signals from the sensor units. If a sensor unit fails to provide an output signal to the controller when a person or object should have been detected, there is an apparent risk for injuries or damages. Conversely, if a sensor unit provides "false alarm" output signals to the controller in situations where rightfully nothing should have been detected, then there is an apparent risk that the controller will command the automatic door operator to stop or block the automatic opening or closing of the movable door members and hence cause user annoyance or dissatisfaction.

The sensor units typically comprise active/passive infrared sensors/detectors, radar/microwave sensors/detectors, image-based sensors/detectors, or combinations thereof.

In order to ensure reliable operation of the sensor units, they need to be configured in the entrance system. Aspects that may need configuration may, for instance and without limitation, include sensor angle, dimensions of the zone/volume to monitor and/or of other parts of the entrance system, ambient light conditions, and stationary sources of interference such as the presence of reflective surfaces, door handles, etc, in the local environment.

In prior art entrance systems, sensor units are typically configured by removing a hood or other part of the apparatus housing of the sensor unit, then pressing a hidden push button to trigger an automatic learning mode and running the automatic door operator to perform a learn cycle during which the movable door members are operated according to a predefined program or manually by the person making the configuration on site. The sensor unit may register certain aspects during the learn cycle and automatically configure itself as regards these aspects.

Other aspects may require manual settings in the sensor unit. Typically, such settings are made by means of dip switches and potentiometers underneath the removable hood of the sensor unit.

The present inventors have realized that there is room for improvements in this field.

One drawback of the prior art approach is that it requires physical intervention since screws or other fastening means will have to be loosened, then the hood itself will have to be removed, and finally the push button, dip switches or potentiometers will have to be actuated. This is a time consuming approach.

Another drawback of the prior art approach is a security risk. Basically anyone equipped with the appropriate tools (which may be as simple as a screwdriver and perhaps a stepladder) can remove the hood of the sensor unit and actuate the push button, dip switches or potentiometers, even if being completely unauthorized or trained for such kind of activity. If the settings of a sensor unit are tampered with, there will be an apparent risk of safety hazards as well as operational malfunctioning.

SUMMARY

An object of the present invention is therefore to provide one or more improvements when it comes to configuration of entrance systems having one or more movable door members and an automatic door operator for causing movements of the one or more movable door members between closed and open positions.

Accordingly, a first aspect of the present invention is a control arrangement for an entrance system having one or more movable door members and an automatic door operator for causing movements of the one or more movable door members between closed and open positions.

The control arrangement comprises a controller and one or more sensor units, each sensor unit being connected to the controller and being arranged to monitor a respective zone at the entrance system for presence or activity of a person or object. At least one sensor unit of said one or more sensor units is an image-based sensor unit which comprises an image sensor arranged for capturing an image of an external object when presented at the image-based sensor unit. The image-based sensor unit also comprises a memory arranged for storing a plurality of settings for the image-based sensor unit, and a processing device operatively connected with the image sensor and the memory.

The processing device is arranged for processing the image captured by the image sensor to identify a machine-readable optical code therein, deriving at least one configuration instruction encoded by the optical code, and executing the derived configuration instruction.

The provision of such a control arrangement will solve or at least mitigate one or more of the problems or drawbacks identified in the above, as will be clear from the following detailed description section and the drawings.

A second aspect of the present invention is an entrance system which comprises one or more movable door members, an automatic door operator for causing movements of the one or more movable door members between closed and open positions, and a control arrangement according to the first aspect of the present invention.

A third aspect of the present invention is a computerized system which comprises an entrance system according to the second aspect of the present invention, and an external computing resource. The external computing resource is arranged for receiving a configuration command from a user, obtaining at least one configuration instruction which matches the received configuration command, generating the machine-readable optical code including encoding the obtained configuration instruction into the optical code, and providing the external object with the generated optical code.

A fourth aspect of the present invention is a configuration method for an entrance system having one or more movable door members, an automatic door operator for causing movements of the one or more movable door members between closed and open positions, and one or more sensor units for monitoring respective zone(s) at the entrance system for presence or activity of a person or object, wherein at least one sensor unit of said one or more sensor units is an image-based sensor unit.

The configuration method comprises capturing an image of an external object by the image-based sensor unit, processing the captured image to identify a machine-readable optical code therein, deriving at least one configuration instruction encoded by the optical code, and executing the derived configuration instruction.

In different embodiments, the one or more movable door members may, for instance, be swing door members, sliding door members, revolving door members, overhead sectional door members, horizontal folding door members or pull-up (vertical lifting) door members.

Embodiments of the invention are defined by the appended dependent claims and are further explained in the detailed description section as well as in the drawings.

It should be emphasized that the term "comprises/comprising" when used in this specification is taken to specify the presence of stated features, integers, steps, or components, but does not preclude the presence or addition of one or more other features, integers, steps, components, or groups thereof. All terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Objects, features and advantages of embodiments of the invention will appear from the following detailed description, reference being made to the accompanying drawings.

DETAILED DESCRIPTION OF EMBODIMENTS

Figure 1:
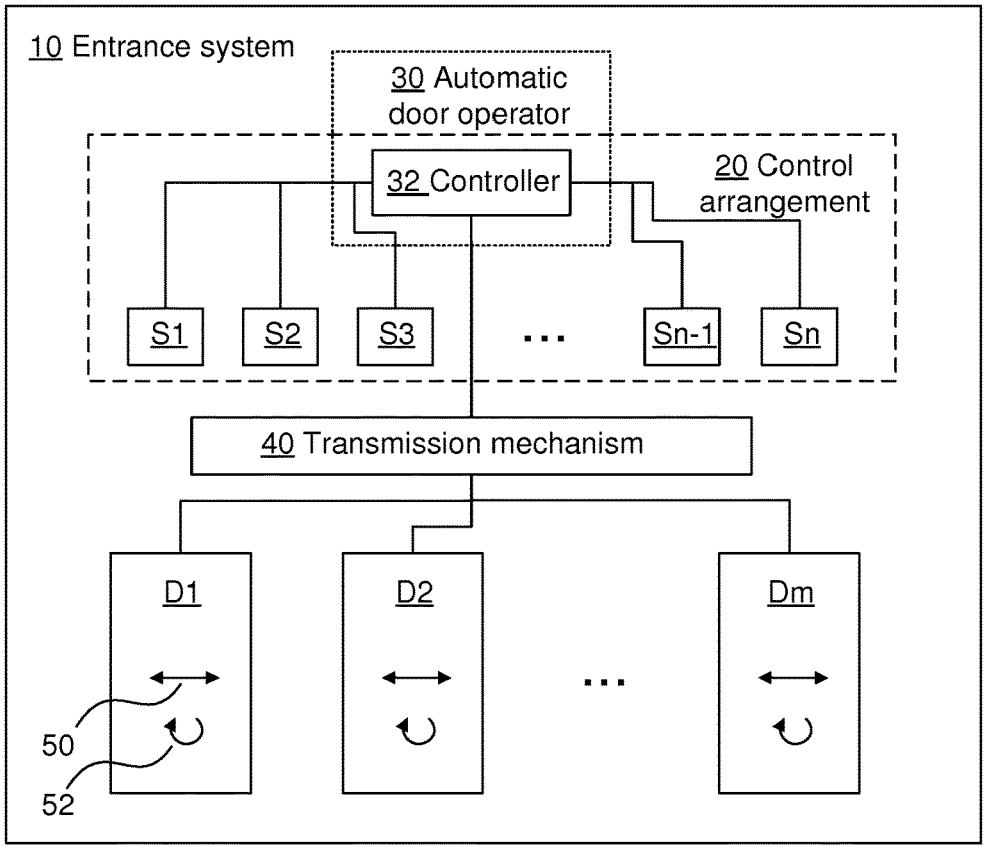
FIG. 1 is a schematic block diagram of an entrance system generally according to the present invention.

Embodiments of the invention will now be described with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular embodiments illustrated in the accompanying drawings is not intended to be limiting of the invention. In the drawings, like numbers refer to like elements.

Figure 2:
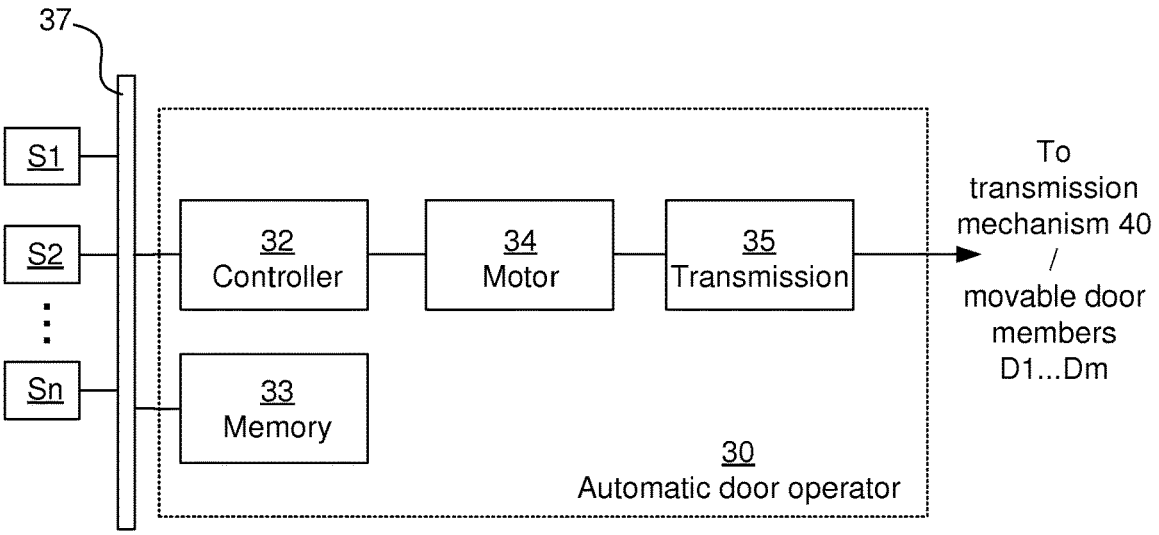
FIG. 2 is a schematic block diagram of an automatic door operator which may be included in the entrance system shown in FIG. 1.

FIG. 1 is a schematic block diagram illustrating an entrance system 10 in which the inventive aspects of the present invention may be applied. The entrance system 10 comprises one or more movable door members D1 . . . Dm, and an automatic door operator 30 for causing movements of the door members D1 . . . Dm between closed and open positions. In FIG. 1, a transmission mechanism 40 conveys mechanical power from the automatic door operator 30 to the movable door members D1 . . . Dm. FIG. 2 illustrates one embodiment of the automatic door operator 30 in more detail.

Pursuant to the invention, a control arrangement 20 is provided for the entrance system 10. The control arrangement 20 comprises a controller 32, which may be part of the automatic door operator 30 as seen in the embodiment of FIG. 2, but which may be a separate device in other embodiments. The control arrangement 20 also comprises a plurality of sensor units S1 . . . Sn. Each sensor unit may generally by connected to the controller 32 by wired connections, wireless connections, or any combination thereof. As will be exemplified in the subsequent description of the three different embodiments in FIGS. 4, 5 and 6, each sensor unit is arranged to monitor a respective zone Z1 . . . Zn at the entrance system 10 for presence or activity of a person or object. The person may be an individual who is present at the entrance system 10, is approaching it or is departing from it. The object may, for instance, be an animal or an article in the vicinity of the entrance system 10, for instance brought by the aforementioned individual. Alternatively, the object may be a vehicle or a robot.

The embodiment of the automatic door operator 30 shown in FIG. 2 will now be described in more detail. The automatic door operator 30 may typically be arranged in conjunction with a frame or other structure which supports the door members D1 . . . Dm for movements between closed and open positions, often as a concealed overhead installation in or at the frame or support structure.

In addition to the aforementioned controller 32, the automatic door operator 30 comprises a motor 34, typically an electrical motor, being connected to an internal transmission or gearbox 35. An output shaft of the transmission 35 rotates upon activation of the motor 34 and is connected to the external transmission mechanism 40. The external transmission mechanism 40 translates the motion of the output shaft of the transmission 35 into an opening or a closing motion of one or more of the door members D1 . . . Dm with respect to the frame or support structure.

The controller 32 is arranged for performing different functions of the automatic door operator 30, possibly in different operational states of the entrance system 10, using inter alia sensor input data from the plurality of sensor units S1 . . . Sn. Hence, the controller 32 is operatively connected with the plurality of sensor units S1 . . . Sn. At least some of the different functions performable by the controller 32 have the purpose of causing desired movements of the door members D1 . . . Dm. To this end, the controller 32 has at least one control output connected to the motor 34 for controlling the actuation thereof.

The controller 32 may be implemented in any known controller technology, including but not limited to microcontroller, processor (e.g. PLC, CPU, DSP), FPGA, ASIC or any other suitable digital and/or analog circuitry capable of performing the intended functionality.

The controller 32 also has an associated memory 33. The memory 33 may be implemented in any known memory technology, including but not limited to E(E)PROM, S(D)RAM or flash memory. In some embodiments, the memory 33 may be integrated with or internal to the controller 32. The memory 33 may store program instructions for execution by the controller 32, as well as temporary and permanent data used by the controller 32.

In the embodiment shown in FIG. 2, the entrance system 10 has a communication bus 37. Some or all of the plurality of sensor units S1 . . . Sn are connected to the communication bus 37, and so is the automatic door operator 30. In the disclosed embodiment, the controller 32 and the memory 33 of the automatic door operator 30 are connected to the communication bus 37; in other embodiments it may be other devices or components of the automatic door operator 30. In still other embodiments, the outputs of the plurality of sensor units S1 . . . Sn may be directly connected to respective data inputs of the controller 32.

At least one of the sensor units S1 . . . Sn is an image-based sensor unit, the abilities of which are used in a novel and inventive way pursuant to the invention for configuring the entrance system 10. An embodiment of such an image-based sensor unit 300 is shown in FIG. 3A.

Figure 3A:
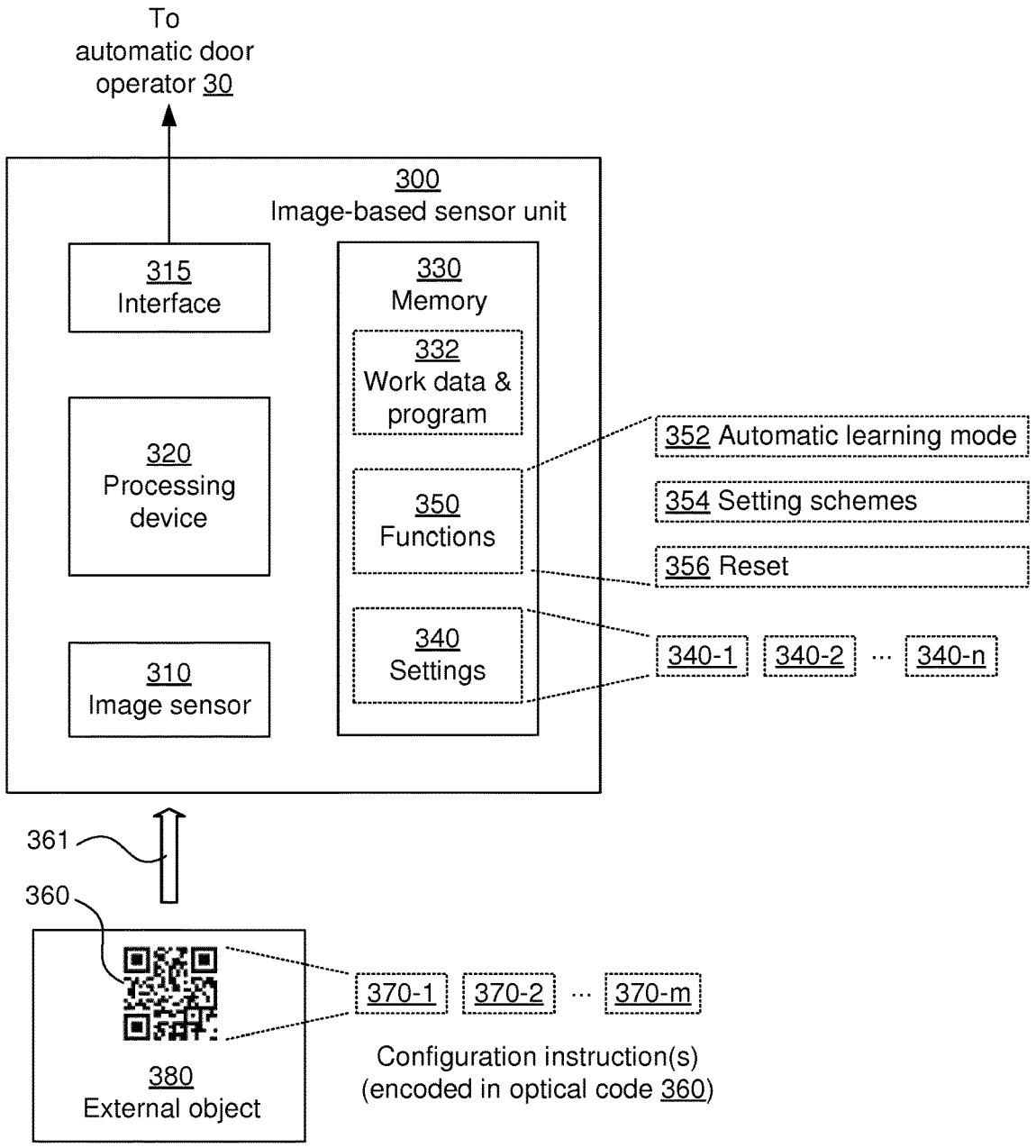
FIG. 3A is a schematic block diagram of an image-based sensor unit in a control arrangement for an entrance system generally according to the present invention, the image-based sensor unit being arranged for capturing an image of an external object, processing the captured image to identify a machine-readable optical code therein, deriving at least one configuration instruction encoded by the optical code, and executing the derived configuration instruction.

As seen in FIG. 3A, the image-based sensor unit 300 comprises an image sensor 310 which is arranged for capturing an image of an external object 380 when presented at the image-based sensor unit 300. The image sensor may, for instance and without limitation, be a semiconductor charge-coupled device (CCD), an active pixel sensor in complementary metal-oxide-semiconductor (CMOS) technology, or an active pixel sensor in N-type metal-oxide-semiconductor (NMOS, Live MOS) technology.

The image-based sensor unit 300 also comprises a memory 330, and a processing device 320 operatively connected with the image sensor 310 and the memory 330. The processing device 320 may, for instance and without limitation, be implemented as a microcontroller, processor (e.g. PLC, CPU, DSP), FPGA, ASIC or any other suitable digital and/or analog circuitry capable of performing the intended functionality. The memory 330 may, for instance and without limitation, be implemented in any known memory technology, including but not limited to E(E)PROM, S(D)RAM or flash memory. In some embodiments, the memory 330 may be integrated with or internal to the processing device 320 or the image sensor 310.

A typical purpose of the image-based sensor unit 300 is to act as a presence sensor, or alternatively an activity sensor, in the entrance system 10. To this end, the memory 330 comprises work data and program code 332 which define the typical tasks of the image-based sensor unit 300 when acting as a presence sensor or activity sensor, namely to process images captured by the image sensor 310, detect presence or activity by a person or object in the zone/volume monitored by the image-based sensor unit 300, and report the detection to the automatic door operator 30. To this end, the image-based sensor unit 300 has an interface 315, for instance an interface for connecting to and communicating on the communication bus 37, or a direct electrical interface for connecting to a data input of the controller 32 of the automatic door operator 30, depending on implementation.

As previously explained, for operational reliability, the image-based sensor unit 300 may need to be configured in terms of, for instance and without limitation, sensor angle, dimensions of the zone/volume to monitor and/or of other parts of the entrance system 10, ambient light conditions, or stationary sources of interference such as the presence of reflective surfaces, door handles, etc, in the local environment. These aspects are collectively referred to as "configurable aspects" in the following. Accordingly, the memory 330 is arranged for storing a plurality of settings 340-1, . .

. , 340-*n* for the image-based sensor unit 300, as can be seen in FIG. 3A. Additionally, the memory 330 may be arranged for storing a plurality of functions 350, which may include an automatic learning mode 352, a plurality of setting schemes 354, a reset function 356, etc.

Figure 7:
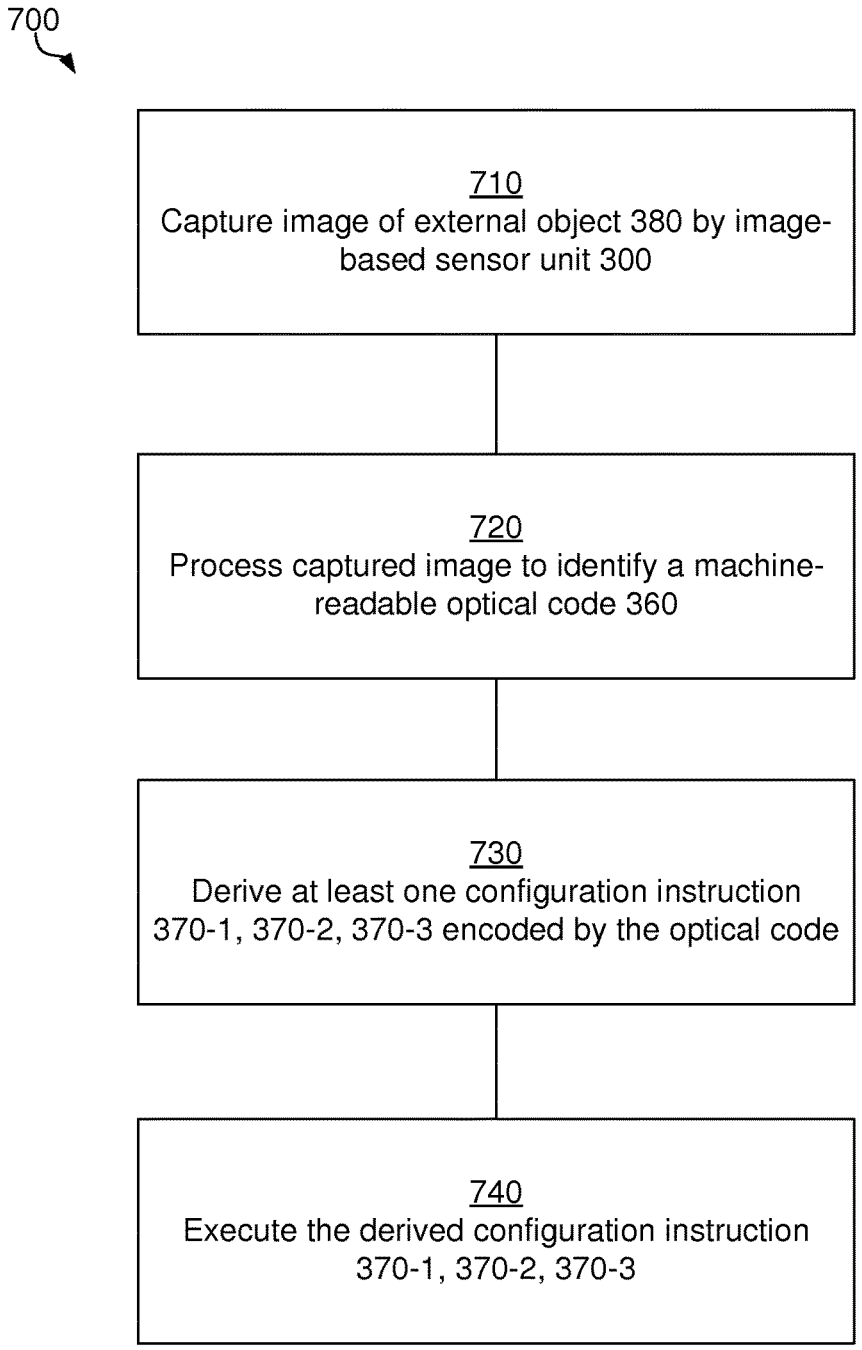
FIG. 7 is a flowchart diagram illustrating a configuration method for an entrance system generally according to the present invention.

A novel and inventive configuration method for the entrance system 10 is made possible thanks to the invention according to the following. This configuration method is outlined as seen at 700 in FIG. 7, and accordingly FIG. 7 will be referred to below in parallel with FIG. 3A in the following description.

It is recalled that the image sensor 310 is arranged for capturing an image of an external object 380 when presented at the image-based sensor unit 300. During normal use, such an external object would be a person or object appearing near the image-based sensor unit 300 in a zone/volume where it should not be for safety reasons, but according to the invention the external object 380 may also be an object which comprises a machine-readable optical code 360.

When the external object 380 with the machine-readable optical code 360 is presented at the image-based sensor unit 300 as seen at 361 in FIG. 3A, the image sensor 310 will accordingly capture an image of the external object 380, and the captured image will contain the machine-readable optical code 360. This can be seen at step 710 in FIG. 7.

The processing device 320 is arranged for processing the image captured by the image sensor 310 so as to identify the machine-readable optical code 360 therein. This can be seen at step 720 in FIG. 7.

The processing device 320 is also arranged for deriving at least one configuration instruction 370-1, 370-2, 370-3 which is encoded by the optical code. This can be seen at step 730 in FIG. 7.

The processing device 320 is moreover arranged for executing the (or each) derived configuration instruction. This can be seen at step 740 in FIG. 7.

In some embodiments, the machine-readable optical code 360 is a two-dimensional barcode. More specifically, as is the case in the disclosed embodiments, the machine-readable optical code 360 is a QR (Quick Response) code. In other embodiments, the machine-readable optical code 360 may be a one-dimensional barcode, such as a UPC (Universal Product Code) or EAN (European Article Number/International Article Number) code. Other alternatives may also exist, as would be clear to the skilled person. The invention is not limited to usage of any specific kind of machine-readable optical code exclusively.

In one embodiment, the derived configuration instruction (for instance 370-1) pertains to configuration of the image-based sensor unit 300 itself. Hence, instead of requiring physical intervention by loosening of screws or other fastening means, removal of the hood of the image-based sensor unit 300 and actuation of a push button, dip switches or potentiometers like in the time-consuming and unsafe prior art approach, configuration of the image-based sensor unit 300 may be done by way of the configuration instruction 370-1 encoded in the graphical code 360.

For instance, the derived configuration instruction 370-1 may specify one of the functions 350 stored in the memory 330 of the image-based sensor unit 300. When the function specified by the derived configuration instruction 370-1 is the automating learning mode 352, the processing device 320 is arranged for executing the derived configuration instruction 370-1 by entering into the automatic learning mode for the image-based sensor unit 300. The automatic learning mode may involve running the automatic door operator (either automatically or manually) to perform a learn cycle during which the movable door members D1 . . . Dm are operated according to a predefined program. The processing device 330 may register some configurable aspects during the learn cycle and automatically configure the sensor unit 300 as regards these aspects by affecting (i.e. setting or updating the values of) one or more of the plurality of settings 340-1, . . . , 340-*n* stored in the memory 330.

Alternatively, the derived configuration instruction 370-1 may specify a setting scheme to be selected for the image-based sensor unit 300. The image-based sensor unit 300 may have a plurality of available setting schemes 354 stored in the memory 330. Each setting scheme may include predefined values of the plurality of settings 340-1, . . . , 340-*n* to be stored in the memory 330. To this end, the processing device 320 of the image-based sensor unit 300 is arranged for executing the derived configuration instruction 370-1 by reading a parameter contained in the configuration instruction 370-1, selecting a setting scheme among the plurality of available setting schemes 354 in accordance with read parameter, and setting or updating the values of the plurality of settings 340-1, . . . , 340-*n* in the memory 330 in accordance with the selected setting scheme.

As a further alternative, the derived configuration instruction 370-1 may specify the reset function 356. Accordingly, the processing device 320 of the image-based sensor unit 300 is arranged for executing the derived configuration instruction 370-1 by performing a reset of the image-based sensor unit 300. This may include resetting the plurality of settings 340-1, . . . , 340-*n* in the memory 330 to default values. It may also include rebooting the processing device 320 and flushing the work data 332.

In the examples above, the derived configuration instruction 370-1 indicates a function 350 of the image-based sensor unit 300. Alternatively, the configuration instruction 370-1 may directly indicate new values to be set for one, some or all of the plurality of settings 340-1, . . . , 340-*n* in the memory 330. Accordingly, the processing device 320 of the image-based sensor unit 300 is arranged for executing the derived configuration instruction 370-1 by reading one or more parameters contained in the configuration instruction, and setting or updating the values of one or more of the plurality of settings 340-1, . . . , 340-*n* stored in the memory 330 in accordance with respective values of the one or more parameters read from the configuration instruction 370-1 derived from the optical code 360.

Combinations are also possible, where for instance one configuration instruction 370-1 derived from the optical code 360 indicates a function 350 to be executed, whereas another configuration instruction derived from the same optical code 360 indicates new values to be set for one or some of the plurality of settings 340-1, . . . , 340-*n*.

In the examples above, the derived configuration instruction 370-1 pertains to configuration of the image-based sensor unit 300 itself. In some embodiments, the derived configuration instruction, for instance 370-2, instead pertains to configuration of another sensor unit, for instance S2, among the sensor units S1 . . . Sn in the entrance system 10. In some embodiments, the derived configuration instruction, for instance 370-3, instead pertains to configuration of the automatic door operator 30 in the entrance system 10.

In such cases, the processing device 320 of the image-based sensor unit 300 reading the optical code 360 may advantageously be arranged for executing the derived configuration instruction 370-2, 370-3 by transmitting the derived configuration instruction in a broadcast message on the communication bus 37. The broadcast message will thus be receivable by any device connected to the communication bus 37, including the other sensor units S2 . . . Sn and the automatic door operator 30. Each receiving device may then decide whether the broadcasted configuration instruction applies to it, and if so execute the configuration instruction.

Alternatively, the processing device 320 of the image-based sensor unit 300 may be arranged for executing the derived configuration instruction 370-2, 370-3 by identifying a recipient device indicated by the configuration instruction 370-2, 370-3, wherein the recipient device is the other sensor unit S2 or the automatic door operator 30, and then transmitting the derived configuration instruction 370-2, 370-3 in a message on the communication bus 37 which is addressed to the recipient device specifically.

Figure 3B:
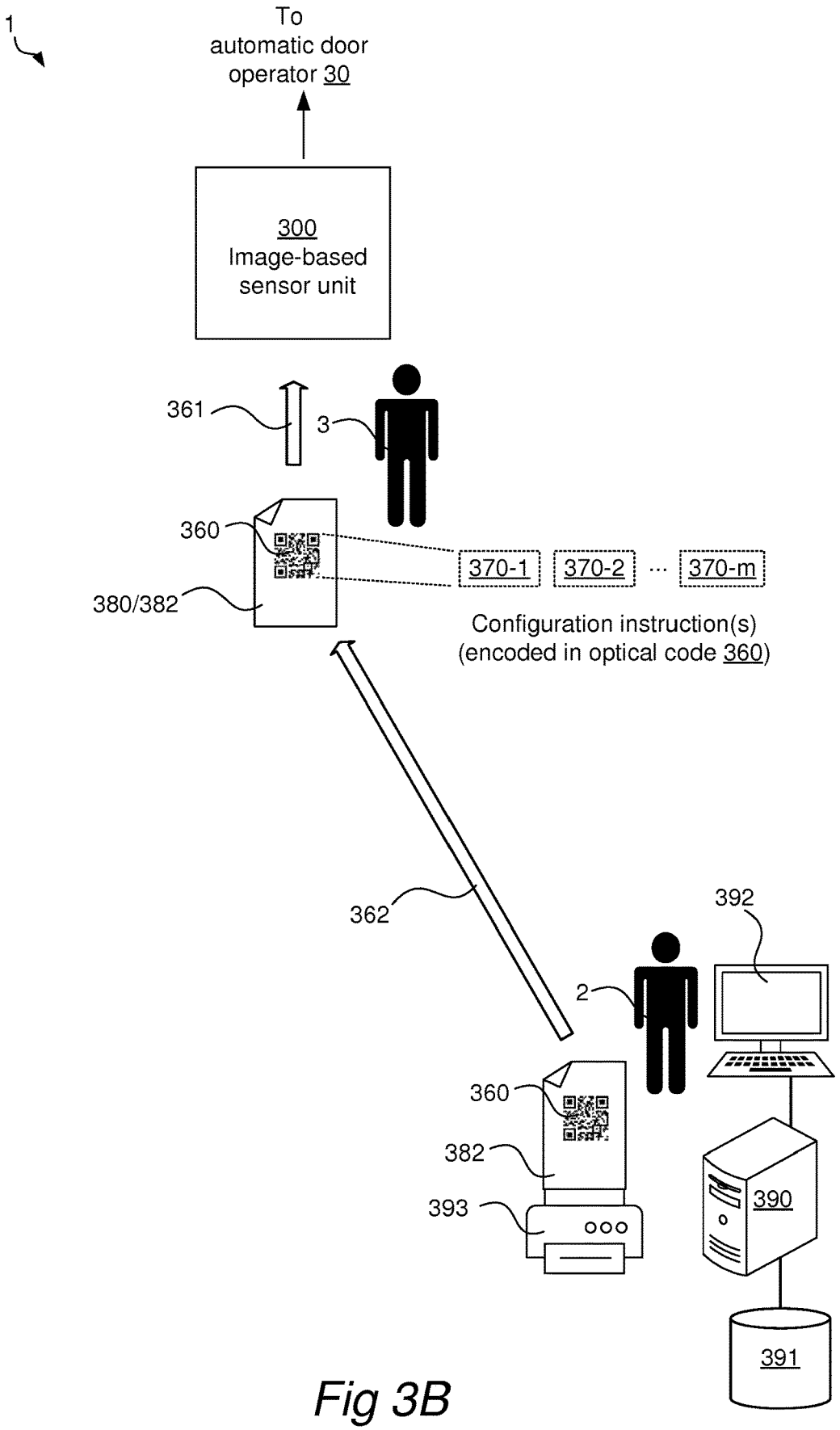
FIG. 3B is a schematic block diagram of a computerized system comprising an entrance system and an external computing resource for receiving a configuration command from a user, obtaining at least one configuration instruction matching the received configuration command, generating a machine-readable optical code which includes the obtained configuration instruction, and providing the external object with the generated optical code, in an embodiment where the external object comprises a piece of paper on which the generated optical code is printed.

Reference is now made to FIG. 3B which is a schematic block diagram of a computerized system 1 that may be used in an embodiment of the present invention to generate the configuration instruction and the machine-readable optical code, and convey it to the image-based sensor unit 300. At the same time, reference is made to FIG. 8 which illustrates corresponding method steps.

As can be seen in FIG. 3B, the computerized system 1 comprises the entrance system 10 as has been described above, and additionally an external computing resource 390. The external computing resource 390 may for instance be a server computer or cloud computing resource having an associated database or other storage 391.

The external computing resource 390 is arranged for receiving a configuration command (or a set of configuration commands) from a user 2. This corresponds to step 810 in FIG. 8. The user 2 may use a terminal computing device 392 to make such input.

The external computing resource 390 is then arranged for obtaining at least one configuration instruction 370-1, 370-2, 370-3 which matches the received configuration command. This corresponds to step 820 in FIG. 8.

The external computing resource 390 is then arranged for generating the machine-readable optical code 360. This includes encoding the obtained configuration instruction 370-1, 370-2, 370-3 into the optical code 360 and corresponds to step 830 in FIG. 8.

The external computing resource 390 is then arranged for providing the external object 380 with the generated optical code 360. This corresponds to step 840 in FIG. 8.

In the embodiment of FIG. 3B, the external object 380 comprises a piece of paper 382. Hence, providing 840 the external object 380/382 with the generated optical code 360 will involve printing the generated optical code 360 on a surface of the piece of paper 382 by means of a printer device 393.

As seen at 362 in FIG. 3B, the piece of paper 382 with the optical code 360 printed thereon may then be brought to the entrance system and be presented to the image-based sensor unit 300 by a user 3 who may or may not be the same person as user 2. After step 840 in FIG. 8, the execution may thus proceed with step 710 in FIG. 7.

Figure 3C:
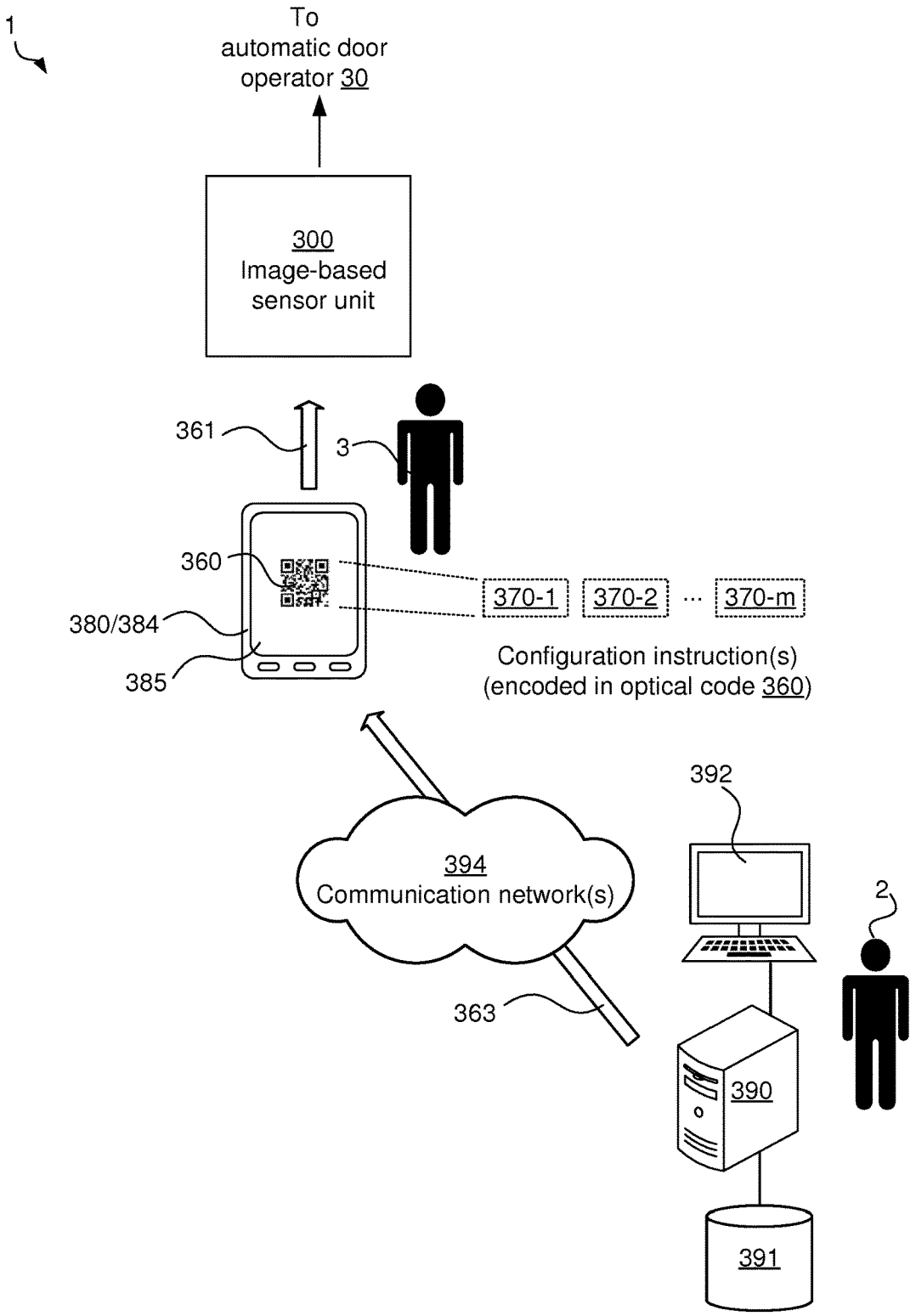
FIG. 3C is a schematic block diagram of another embodiment of the computerized system, wherein the external object comprises a mobile communication device with a display screen for presenting the generated optical code.

An alternative embodiment of the computerized system 1 is shown in FIG. 3C. Here, the external object 380 comprises a mobile communication device 384 with a display screen 385 for presenting the generated optical code 360. The mobile communication device 384 may, for instance, be a mobile terminal, smartphone, tablet computer or the like.

In this embodiment, as seen at 363 in FIG. 3C, the external computing resource 390 is arranged for providing 840 the external object 380/384 with the optical code 360 (after having been generated in response to the configuration command by the user 2) by transmitting the generated optical code 360 over a communications network 394 to the mobile communication device 384. The communications network 394 may comply with any commercially available mobile telecommunications standard, including but not limited to GSM, UMTS, LTE, D-AMPS, CDMA2000, FOMA and TD-SCDMA. Alternatively or additionally, the communications network 394 may comply with any commercially available standard for data communication, such as for instance TCP/IP. Alternatively or additionally, the communications network 394 may comply with one or more short-range wireless data communication standards such as Bluetooth®, WiFi (e.g. IEEE 802.11, wireless LAN), Near Field Communication (NFC), RF-ID (Radio Frequency Identification) or Infrared Data Association (IrDA).

In the embodiment of FIG. 3C, the optical code 360 will be received over the communications network 394 by the mobile communication device 384, and then the received optical code 360 will be presented on the display screen 385 of the mobile communication device 384. The user 3 may thus present it to the image-based sensor unit 300. Again, after step 840 in FIG. 8, the execution may then proceed with step 710 in FIG. 7.

Figure 3D:
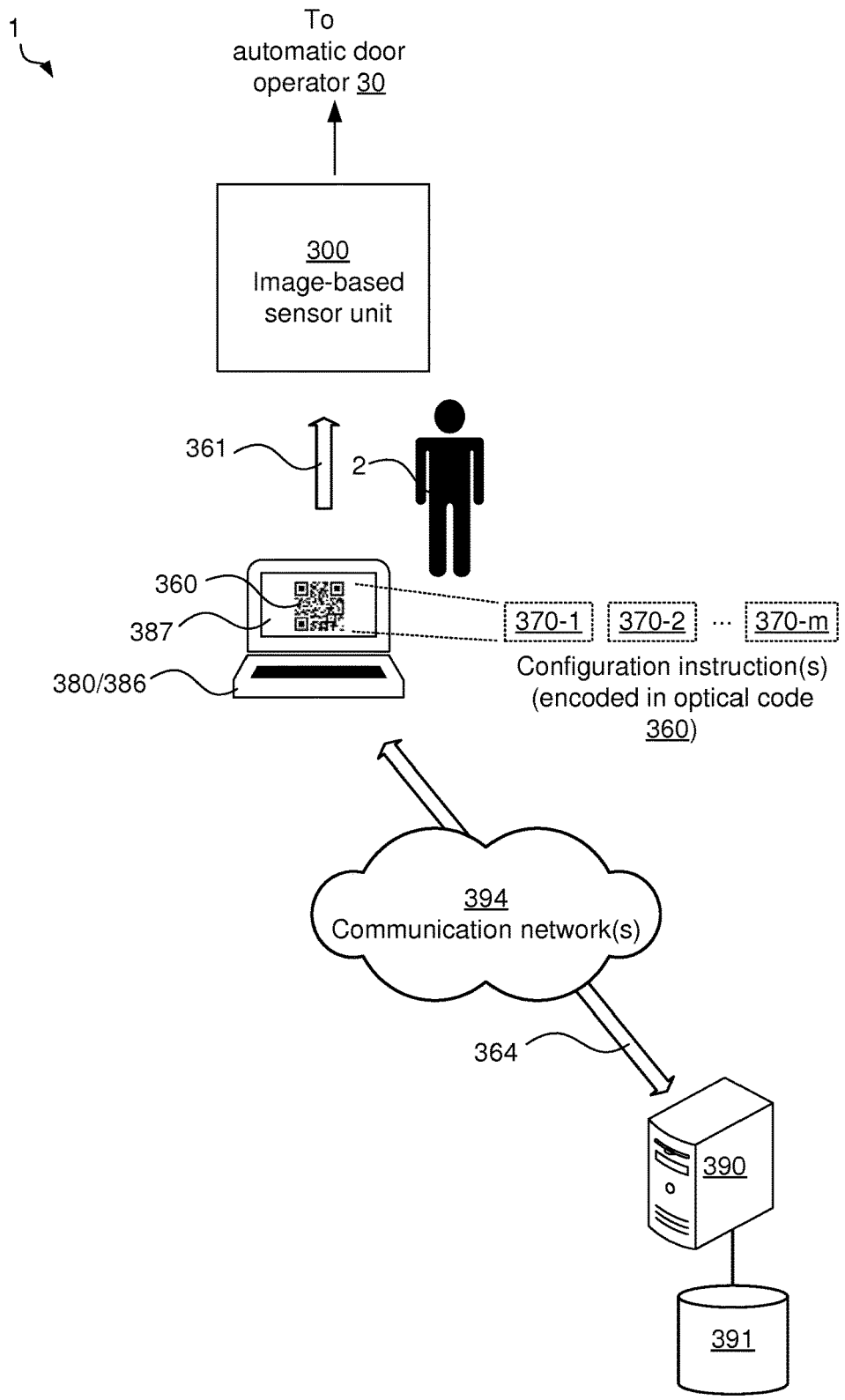
FIG. 3D is a schematic block diagram of yet another embodiment of the computerized system, wherein the computing resource includes a portable computing device which also serves as the external object, the generated optical code being presented on a display screen of the portable computing device.

Yet an alternative embodiment of the computerized system 1 is shown in FIG. 3D. Here, the computing resource 390 includes a portable computing device 386, such as a laptop computer (or alternatively a mobile communication device as referred to above for FIG. 3C). In this embodiment, the external object 380 is a display screen 387 of the portable computing device 386.

The user 2 accesses (see 364) the central/server part of the computing resource 390 over the communications network 394 and provides the configuration command as previously discussed. The generated graphical code 360 is downloaded (see 364) to the portable computing device 386 and presented on the display screen 387.

Figure 8:
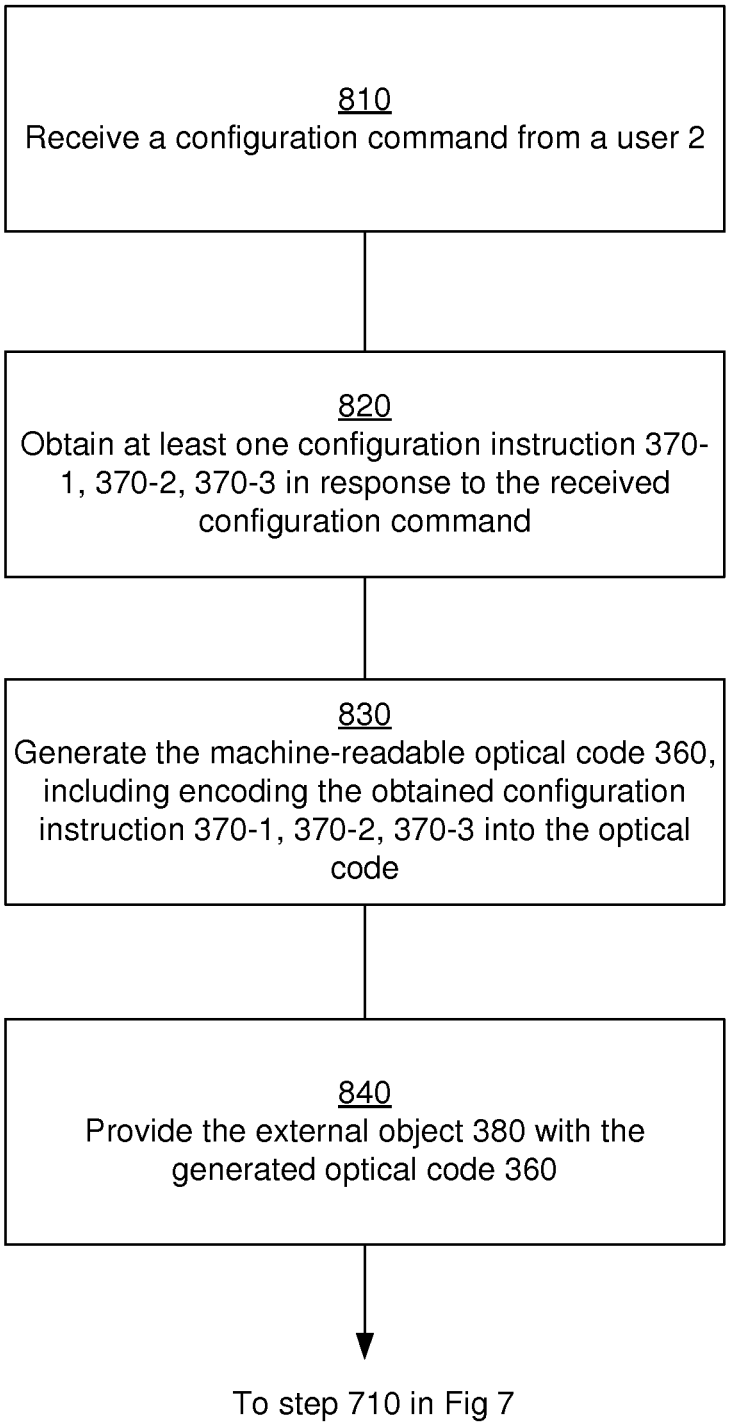
FIG. 8 is a flowchart diagram illustrating a configuration method according to an embodiment of the present invention.

Embodiments are also possible where the steps of FIG. 8 are performed solely in and by the portable computing device 386; in such cases there may not be a need for the central/server part of the computing resource 390, nor the communications network 394.

Three different exemplifying embodiments of the entrance system 10 will now be described with reference to FIGS. 4, 5 and 6.

Figure 4:
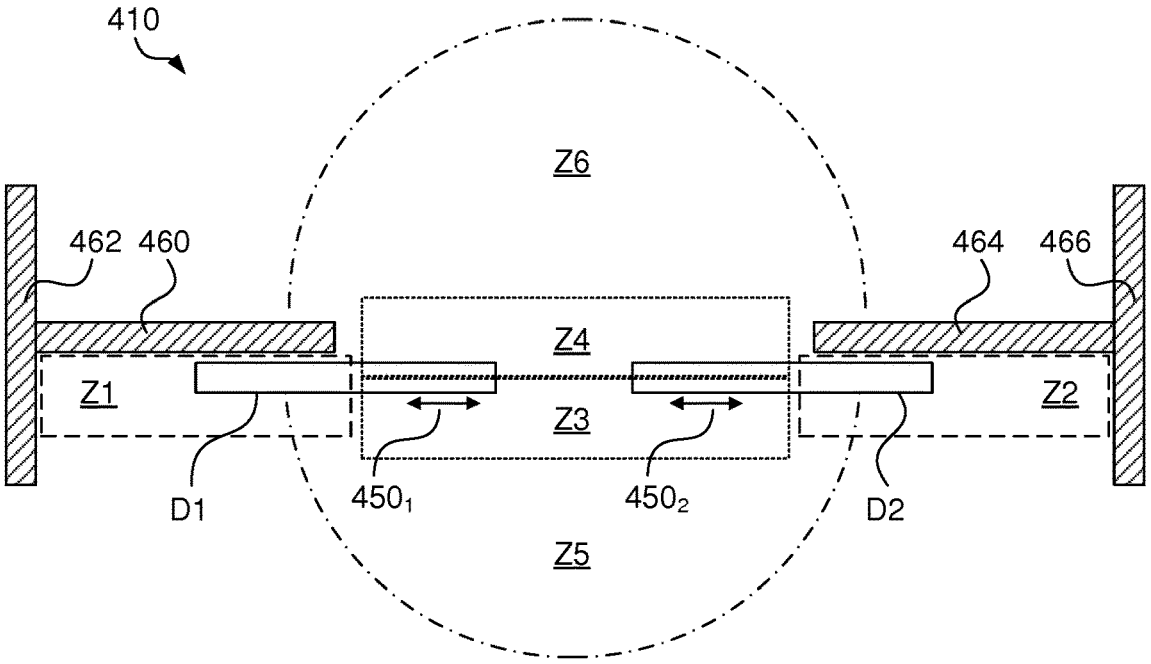
FIG. 4 is a schematic top view of an entrance system according to a first embodiment, in the form of a sliding door system.

Turning first to FIG. 4, a first embodiment of an entrance system in the form of a sliding door system 410 is shown in a schematic top view. The sliding door system 410 comprises first and second sliding doors or wings D1 and D2, being supported for sliding movements $\mathbf{450}_1$ and $\mathbf{450}_2$ in parallel with first and second wall portions 460 and 464. The first and second wall portions 460 and 464 are spaced apart; in between them there is formed an opening which the sliding doors D1 and D2 either blocks (when the sliding doors are in closed positions), or makes accessible for passage (when the sliding doors are in open positions). An automatic door operator (not seen in FIG. 4 but referred to as 30 in FIGS. 1 and 2) causes the movements $\mathbf{450}_1$ and $\mathbf{450}_2$ of the sliding doors D1 and D2.

The sliding door system 410 comprises a plurality of sensor units, each monitoring a respective zone Z1-Z6. The sensor units themselves are not shown in FIG. 4, but they are generally mounted at or near ceiling level and/or at positions which allow them to monitor their respective zones Z1-Z6. To facilitate the reading, each sensor unit will be referred to as Sx in the following, where x is the same number as in the zone Zx it monitors (Sx=S1-S6, Zx=Z1-Z6).

A first sensor unit S1 is mounted at a lateral position to the far left in FIG. 4 to monitor zone Z1. The first sensor unit S1 is a side presence sensor, and the purpose is to detect when a person or object occupies a space between the outer lateral edge of the sliding door D1 and an inner surface of a wall or other structure 462 when the sliding door D1 is moved towards the left in FIG. 4 during an opening state of the sliding door system 410. The provision of the side presence sensor S1 will help avoiding a risk that the person or object will be hit by the outer lateral edge of the sliding door D1, and/or jammed between the outer lateral edge of the sliding door D1 and the inner surface of the wall 462, by triggering abort and preferably reversal of the ongoing opening movement of the sliding door D1.

A second sensor unit S2 is mounted at a lateral position to the far right in FIG. 4 to monitor zone Z2. The second sensor unit S2 is a side presence sensor, just like the first sensor unit S1, and has the corresponding purpose—i.e. to detect when a person or object occupies a space between the outer lateral edge of the sliding door D2 and an inner surface of a wall 466 when the sliding door D2 is moved towards the right in FIG. 4 during the opening state of the sliding door system 410.

A third sensor unit S3 is mounted at a first central position in FIG. 4 to monitor zone Z3. The third sensor unit S3 is a door presence sensor, and the purpose is to detect when a person or object occupies a space between or near the inner lateral edges of the sliding doors D1 and D2 when the sliding doors D1 are moved towards each other in FIG. 4 during a closing state of the sliding door system 410. The provision of the door presence sensor S3 will help avoiding a risk that the person or object will be hit by the inner lateral edge of the sliding door D1 or D2, and/or be jammed between the inner lateral edges of the sliding doors D1 and D2, by aborting and preferably reversing the ongoing closing movements of the sliding doors D1 and D2.

A fourth sensor unit S4 is mounted at a second central position in FIG. 4 to monitor zone Z4. The fourth sensor unit S4 is a door presence sensor, just like the third sensor unit S3, and has the corresponding purpose—i.e. to detect when a person or object occupies a space between or near the inner lateral edges of the sliding doors D1 and D2 when the sliding doors D1 are moved towards each other in FIG. 4 during a closing state of the sliding door system 410.

Advantageously, at least one of the side presence sensors S1 and S2 and door presence sensors S3 and S4 is an image-based sensor unit (thus implementing the image-based sensor unit 300 according to the description above). Otherwise, they may for instance be active IR (infrared) sensors.

A fifth sensor unit S5 is mounted at an inner central position in FIG. 4 to monitor zone Z5. The fifth sensor unit S5 is an inner activity sensor, and the purpose is to detect when a person or object approaches the sliding door system 410 from the inside of the premises. The provision of the inner activity sensor S5 will trigger the sliding door system 410, when being in a closed state or a closing state, to automatically switch to an opening state for opening the sliding doors D1 and D2, and then make another switch to an open state when the sliding doors D1 and D2 have reached their fully open positions.

A sixth sensor unit S6 is mounted at an outer central position in FIG. 4 to monitor zone Z6. The sixth sensor unit S6 is an outer activity sensor, and the purpose is to detect when a person or object approaches the sliding door system 410 from the outside of the premises. Similar to the inner activity sensor S5, the provision of the outer activity sensor S6 will trigger the sliding door system 410, when being in its closed state or its closing state, to automatically switch to the opening state for opening the sliding doors D1 and D2, and then make another switch to an open state when the sliding doors D1 and D2 have reached their fully open positions.

The inner activity sensor S5 and the outer activity sensor S6 may for instance be radar (microwave) sensors; however one or both of them may alternatively be an image-based sensor unit (thus implementing the image-based sensor unit 300 according to the description above).

Figure 5:
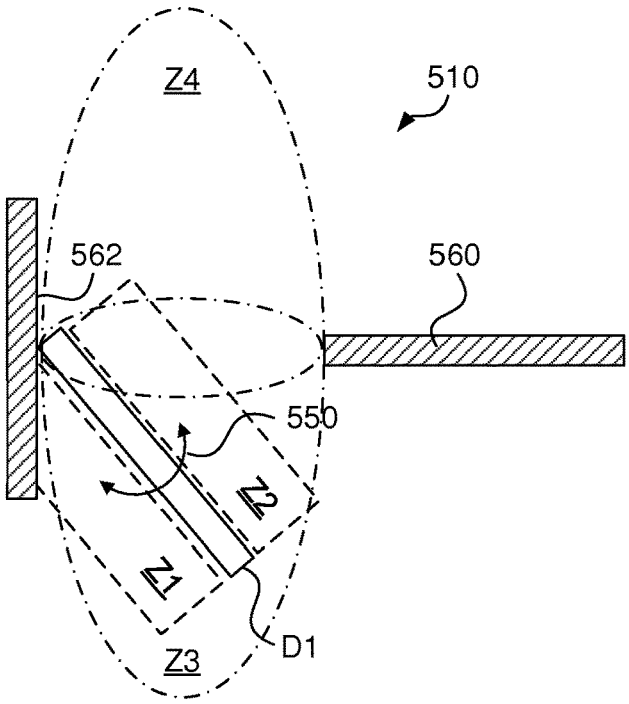
FIG. 5 is a schematic top view of an entrance system according to a second embodiment, in the form of a swing door system.

A second embodiment of an entrance system in the form of a swing door system 510 is shown in a schematic top view in FIG. 5. The swing door system 510 comprises a single swing door D1 being located between a lateral edge of a first wall 560 and an inner surface of a second wall 562 which is perpendicular to the first wall 560. The swing door D1 is supported for pivotal movement 550 around pivot points on or near the inner surface of the second wall 562. The first and second walls 560 and 562 are spaced apart; in between them an opening is formed which the swing door D1 either blocks (when the swing door is in closed position), or makes accessible for passage (when the swing door is in open position). An automatic door operator (not seen in FIG. 5 but referred to as 30 in FIGS. 1 and 2) causes the movement 550 of the swing door D1.

The swing door system 510 comprises a plurality of sensor units, each monitoring a respective zone Z1-Z4. The sensor units themselves are not shown in FIG. 5, but they are generally mounted at or near ceiling level and/or at positions which allow them to monitor their respective zones Z1-Z4. Again, each sensor unit will be referred to as Sx in the following, where x is the same number as in the zone Zx it monitors (Sx=S1-S4, Zx=Z1-Z4).

A first sensor unit S1 is mounted at a first central position in FIG. 5 to monitor zone Z1. The first sensor unit S1 is a door presence sensor, and the purpose is to detect when a person or object occupies a space near a first side of the (door leaf of the) swing door D1 when the swing door D1 is being moved towards the open position during an opening state of the swing door system 510. The provision of the door presence sensor S1 will help avoiding a risk that the person or object will be hit by the first side of the swing door D1 and/or be jammed between the first side of the swing door D1 and the second wall 562; a sensor detection in this situation will trigger abort and preferably reversal of the ongoing opening movement of the swing door D1.

A second sensor unit S2 is mounted at a second central position in FIG. 5 to monitor zone Z2. The second sensor unit S2 is a door presence sensor, just like the first sensor S1, and has the corresponding purpose—i.e. to detect when a person or object occupies a space near a second side of the swing door D1 (the opposite side of the door leaf of the swing door D1) when the swing door D1 is being moved towards the closed position during a closing state of the swing door system 510. Hence, the provision of the door presence sensor S2 will help avoiding a risk that the person or object will be hit by the second side of the swing door D1 and/or be jammed between the second side of the swing door D1 and the first wall 560; a sensor detection in this situation will trigger abort and preferably reversal of the ongoing closing movement of the swing door D1.

Advantageously, at least one of the door presence sensors S1 and S2 is an image-based sensor unit (thus implementing the image-based sensor unit 300 according to the description above). Otherwise, they may for instance be active IR (infrared) sensors.

A third sensor unit S3 is mounted at an inner central position in FIG. 5 to monitor zone Z3. The third sensor unit S3 is an inner activity sensor, and the purpose is to detect when a person or object approaches the swing door system 510 from the inside of the premises. The provision of the inner activity sensor S3 will trigger the sliding door system 510, when being in a closed state or a closing state, to automatically switch to an opening state for opening the swing door D1, and then make another switch to an open state when the swing door D1 has reached its fully open position.

A fourth sensor unit S4 is mounted at an outer central position in FIG. 5 to monitor zone Z4. The fourth sensor unit S4 is an outer activity sensor, and the purpose is to detect when a person or object approaches the swing door system 510 from the outside of the premises. Similar to the inner activity sensor S3, the provision of the outer activity sensor S4 will trigger the swing door system 510, when being in its closed state or its closing state, to automatically switch to the opening state for opening the swing door D1, and then make another switch to an open state when the swing door D1 has reached its fully open position.

The inner activity sensor S3 and the outer activity sensor S4 may for instance be radar (microwave) sensors; however one or both of them may alternatively be an image-based sensor unit (thus implementing the image-based sensor unit 300 according to the description above).

Figure 6:
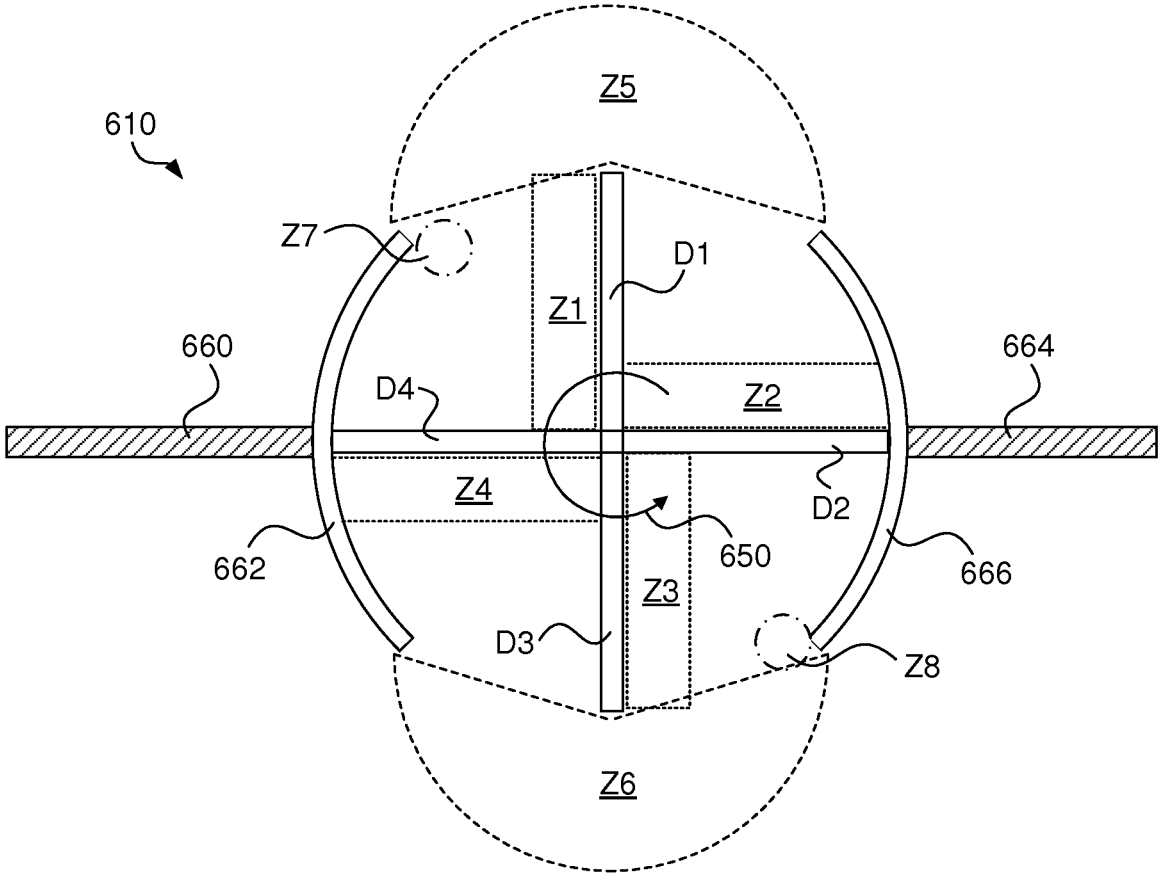
FIG. 6 is a schematic top view of an entrance system according to a third embodiment, in the form of a revolving door system.

A third embodiment of an entrance system in the form of a revolving door system 610 is shown in a schematic top view in FIG. 6. The revolving door system 610 comprises a plurality of revolving doors or wings D1-D4 being located in a cross configuration in an essentially cylindrical space between first and second curved wall portions 662 and 666 which, in turn, are spaced apart and located between third and fourth wall portions 660 and 664. The revolving doors D1-D4 are supported for rotational movement 650 in the cylindrical space between the first and second curved wall portions 662 and 666. During the rotation of the revolving doors D1-D4, they will alternatingly prevent and allow passage through the cylindrical space. An automatic door operator (not seen in FIG. 6 but referred to as 30 in FIGS. 1 and 2) causes the rotational movement 650 of the revolving doors D1-D4.

The revolving door system 610 comprises a plurality of sensor units, each monitoring a respective zone Z1-Z8. The sensor units themselves are not shown in FIG. 6, but they are generally mounted at or near ceiling level and/or at positions which allow them to monitor their respective zones Z1-Z8. Again, each sensor unit will be referred to as Sx in the following, where x is the same number as in the zone Zx it monitors (Sx=S1-S8, Zx=Z1-Z8).

First to fourth sensor units S1-S4 are mounted at respective first to fourth central positions in FIG. 6 to monitor zones Z1-Z4. The first to fourth sensor units S1-S4 are door presence sensors, and the purpose is to detect when a person or object occupies a respective space (sub-zone of Z1-Z4) near one side of the (door leaf of the) respective revolving door D1-D4 as it is being rotationally moved during a rotation state or start rotation state of the revolving door system 610. The provision of the door presence sensors S1-S4 will help avoiding a risk that the person or object will be hit by the approaching side of the respective revolving door D1-D4 and/or be jammed between the approaching side of the respective revolving door D1-D4 and end portions of the first or second curved wall portions 662 and 666. When any of the door presence sensors S1-S4 detects such a situation, it will trigger abort and possibly reversal of the ongoing rotational movement 650 of the revolving doors D1-D4.

Advantageously, at least one of the door presence sensors S1-S4 is an image-based sensor unit (thus implementing the image-based sensor unit 300 according to the description above). Otherwise, they may for instance be active IR (infrared) sensors.

A fifth sensor unit S5 is mounted at an inner non-central position in FIG. 6 to monitor zone Z5. The fifth sensor unit S5 is an inner activity sensor, and the purpose is to detect when a person or object approaches the revolving door system 610 from the inside of the premises. The provision of the inner activity sensor S5 will trigger the revolving door system 610, when being in a no rotation state or an end rotation state, to automatically switch to a start rotation state to begin rotating the revolving doors D1-D4, and then make another switch to a rotation state when the revolving doors D1-D4 have reached full rotational speed.

A sixth sensor unit S6 is mounted at an outer non-central position in FIG. 6 to monitor zone Z6. The sixth sensor unit S6 is an outer activity sensor, and the purpose is to detect when a person or object approaches the revolving door system 610 from the outside of the premises. Similar to the inner activity sensor S5, the provision of the outer activity sensor S6 will trigger the revolving door system 610, when being in its no rotation state or end rotation state, to automatically switch to the start rotation state to begin rotating the revolving doors D1-D4, and then make another switch to the rotation state when the revolving doors D1-D4 have reached full rotational speed.

The inner activity sensor S5 and the outer activity sensor S6 may for instance be radar (microwave) sensors; however one or both of them may alternatively be an image-based sensor unit (thus implementing the image-based sensor unit 300 according to the description above).

Seventh and eighth sensor units S7 and S8 are mounted near the ends of the first or second curved wall portions 662 and 666 to monitor zones Z7 and Z8. The seventh and eighth sensor units S7 and S8 are vertical presence sensors. The provision of these sensor units S7 and S8 will help avoiding a risk that the person or object will be jammed between the approaching side of the respective revolving door D1-D4 and an end portion of the first or second curved wall portions 662 and 666 during the start rotation state and the rotation state of the revolving door system 610. When any of the vertical presence sensors S7-S8 detects such a situation, it will trigger abort and possibly reversal of the ongoing rotational movement 650 of the revolving doors D1-D4.

At least one of the vertical presence sensors S7-S8 may be an image-based sensor unit (thus implementing the image-based sensor unit 300 according to the description above). Otherwise, they may for instance be active IR (infrared) sensors.

The invention has been described above in detail with reference to embodiments thereof. However, as is readily understood by those skilled in the art, other embodiments are equally possible within the scope of the present invention, as defined by the appended claims.

The invention claimed is:

1. A control arrangement for an entrance system having one or more movable door members, a communication bus, and an automatic door operator for causing movements of the one or more movable door members between closed and open positions, the control arrangement comprising:

a controller; and one or more sensor units, each sensor unit being connected to the controller and being arranged to monitor a respective zone at the entrance system for presence or activity of a person or object, wherein at least one sensor unit of the one or more sensor units is an image-based sensor unit, the image-based sensor unit comprising:

an image sensor arranged for capturing an image of an external object;

a memory arranged for storing a plurality of settings for the image-based sensor unit; and a processing device operatively connected with the image sensor and the memory, wherein the processing device is arranged for processing the image captured by the image sensor to identify a machine-readable optical code therein, deriving one or more configuration instructions encoded by the optical code, and executing the one or more configuration instructions.

2. The control arrangement as defined in claim 1, wherein at least one of the one or more configuration instructions pertains to configuration of the image-based sensor unit.

3. The control arrangement as defined in claim 2, wherein the processing device of the image-based sensor unit is arranged for executing the one or more configuration instructions by entering into an automatic learning mode for the image-based sensor unit, the automatic learning mode affecting one or more of the plurality of settings stored in the memory.

4. The control arrangement as defined in claim 2, wherein the processing device of the image-based sensor unit is arranged for executing the one or more configuration instructions by:

reading one or more parameters contained in the one or more configuration instructions; and setting or updating the values of one or more of the plurality of settings stored in the memory in accordance with respective values of the one or more parameters.

5. The control arrangement as defined in claim 2, wherein the image-based sensor unit has a plurality of available setting schemes, each available setting scheme including predefined values of the plurality of settings to be stored in the memory, and the processing device of the image-based sensor unit is arranged for executing the one or more configuration instructions by:

reading a parameter contained in the one or more configuration instructions;

selecting a setting scheme among the plurality of available setting schemes in accordance with the parameter; and setting or updating the values of the plurality of settings stored in the memory in accordance with the setting scheme.

6. The control arrangement as defined in claim 2, wherein the processing device of the image-based sensor unit is arranged for executing the one or more configuration instructions by performing a reset of the image-based sensor unit.

7. The control arrangement as defined in claim 1, wherein the one or more configuration instructions pertains to configuration of another sensor unit among the one or more sensor units.

8. The control arrangement as defined in claim 7, wherein the one or more sensor units and the automatic door operator are connected to the communication bus, wherein the processing device of the image-based sensor unit is arranged for executing the one or more configuration instructions by transmitting the one or more configuration instructions in a broadcast message on the communication bus, the broadcast message being receivable by any device connected to the communication bus.

9. The control arrangement as defined in claim 7, wherein the one or more sensor units and the automatic door operator are connected to the communication bus, wherein the processing device of the image-based sensor unit is arranged for executing the one or more configuration instructions by:

identifying a recipient device indicated by the one or more configuration instructions, the recipient device being one of the another sensor unit or the automatic door operator; and transmitting the one or more configuration instructions in a message on the communication bus and addressed to the recipient device.

10. The control arrangement as defined in claim 1, wherein the one or more configuration instructions pertains to configuration of the automatic door operator.

11. The control arrangement as defined in claim 1, wherein the machine-readable optical code is a two-dimensional barcode comprising a Quick Response (QR) code.

12. The control arrangement as defined in claim 1, wherein the machine-readable optical code is a one-dimensional barcode comprising a Universal Product Code (UPC) or a European Article Number (EAN) code.

13. An entrance system comprising:

one or more movable door members;

an automatic door operator for causing movements of the one or more movable door members between closed and open positions; and a control arrangement, wherein the control arrangement comprises:

a controller; and one or more sensor units, each sensor unit being connected to the controller and being arranged to monitor a respective zone at the entrance system for presence or activity of a person or object, wherein at least one sensor unit of the one or more sensor units is an image-based sensor unit comprising:

an image sensor arranged for capturing an image of an external object;

a memory arranged for storing a plurality of settings for the image-based sensor unit; and a processing device operatively connected with the image sensor and the memory, wherein the processing device is arranged for processing the image captured by the image sensor to identify a machine-readable optical code therein, deriving one or more configuration instructions encoded by the optical code, and executing the one or more configuration instructions.

14. A computerized system comprising:

an entrance system having one or more movable door members, an automatic door operator for causing movements of the one or more movable door members between closed and open positions, and a control arrangement, the control arrangement comprising:

a controller; and one or more sensor units, each sensor unit being connected to the controller and being arranged to monitor a respective zone at the entrance system for presence or activity of a person or object, wherein at least one sensor unit of the one or more sensor units is an image-based sensor unit comprising:

an image sensor arranged for capturing an image of an external object;

a memory arranged for storing a plurality of settings for the image-based sensor unit; and a processing device operatively connected with the image sensor and the memory, wherein the processing device is arranged for processing the image captured by the image sensor to identify a machine-readable optical code therein, deriving one or more configuration instructions encoded by the optical code, and executing the one or more configuration instructions; and an external computing resource arranged for:

receiving a configuration command from a user;

obtaining the one or more configuration instructions matching the configuration command;

generating a machine-readable optical code including encoding the one or more configuration instructions into the optical code; and providing an external object with the optical code.

15. A configuration method for an entrance system, the entrance system having one or more movable door members, an automatic door operator for causing movements of the one or more movable door members between closed and open positions, and one or more sensor units for monitoring one or more respective zones at the entrance system for presence or activity of a person or object, at least one sensor unit of the one or more sensor units being an image-based sensor unit, the configuration method comprising:

capturing an image of an external object by the image-based sensor unit;

processing the image, by the image-based sensor unit, to identify a machine-readable optical code therein;

deriving, by the image-based sensor unit, one or more configuration instructions encoded by the optical code; and executing, by the image-based sensor unit, the one or more configuration instructions.

16. The configuration method as defined in claim 15, further comprises the initial steps, at a computing resource external to the entrance system, of:

receiving a configuration command from a user;

obtaining the one or more configuration instructions in response to the configuration command;

generating the machine-readable optical code including encoding the one or more configuration instructions into the optical code; and providing the external object with the optical code.

17. The configuration method as defined in claim 16, wherein the external object comprises a piece of paper, and wherein the providing the external object with the optical code includes printing the optical code on a surface of the piece of paper.

18. The configuration method as defined in claim 16, wherein the external object comprises a mobile communication device, and wherein the providing the external object with the optical code includes transmitting the optical code over a communications network to the mobile communication device.

19. The configuration method as defined in claim 18, further comprising:

receiving the optical code over the communications network at the mobile communication device; and presenting the optical code on a display screen of the mobile communication device.

20. The configuration method as defined in claim 16, wherein the computing resource includes a portable computing device, wherein the external object is a display screen of the portable computing device, and wherein the providing the external object with the optical code includes presenting the optical code on the display screen.

* * * * *